US007690866B2

(12) United States Patent
Thomas et al.

(10) Patent No.: US 7,690,866 B2
(45) Date of Patent: Apr. 6, 2010

(54) OFFSHORE OIL-DRILLING RIG AND METHODS FOR INSTALLING SAME ON AN OFFSHORE OIL-DRILLING SITE

(75) Inventors: Pierre-Armand Thomas, Puteaux (FR); Nicolas Tcherniguin, Paris (FR)

(73) Assignee: Technip France (FR)

( * ) Notice: Subject to any disclaimer, the term of this patent is extended or adjusted under 35 U.S.C. 154(b) by 174 days.

(21) Appl. No.: 11/576,630

(22) PCT Filed: Sep. 26, 2005

(86) PCT No.: PCT/FR2005/002379

§ 371 (c)(1),
(2), (4) Date: Apr. 4, 2007

(87) PCT Pub. No.: WO2006/037871

PCT Pub. Date: Apr. 13, 2006

(65) Prior Publication Data

US 2007/0231075 A1 Oct. 4, 2007

(30) Foreign Application Priority Data

Oct. 6, 2004 (FR) ..... 04 10545

(51) Int. Cl.
*E02B 17/02* (2006.01)

(52) U.S. Cl. ..... 405/227; 405/203

(58) Field of Classification Search ..... 405/196, 405/203, 224, 224.1, 227
See application file for complete search history.

(56) References Cited

U.S. PATENT DOCUMENTS

| | | | | |
|---|---|---|---|---|
| 2,908,142 | A | 10/1959 | Suderow | 61/46.5 |
| 2,909,901 | A | 10/1959 | Suderow | 61/46.5 |
| 2,994,202 | A * | 8/1961 | Knapp et al. | 405/224 |
| 3,797,256 | A * | 3/1974 | Giblon | 405/196 |
| 4,372,707 | A * | 2/1983 | Ostgaard | 405/224 |

OTHER PUBLICATIONS

International Search Report PCT/FR2005/002379 dated Jan. 13, 2006.

* cited by examiner

*Primary Examiner*—John Kreck
(74) *Attorney, Agent, or Firm*—Ostrolenk Faber LLP

(57) ABSTRACT

An offshore oil-drilling rig comprising a deck mounted mobile on legs, each leg including a support base on the sea floor and a caisson open at its base and designed to penetrate into the sea floor. Each caisson is arranged inside the leg and is mobile along the axis of the leg between a retracted upper position and a projecting lower position at which it is anchored on the sea floor. The invention also concerns methods for installing such a rig on an oil-drilling site.

8 Claims, 7 Drawing Sheets

OFFSHORE OIL-DRILLING RIG AND METHODS FOR INSTALLING SAME ON AN OFFSHORE OIL-DRILLING SITE

CROSS REFERENCE TO RELATED APPLICATION

This is a 35 U.S.C. §§371 national phase conversion of PCT/FR2005/002379, filed Sep. 26, 2005, which claims priority of French Application No. 0410545, filed Oct. 6, 2004. The PCT International Application was published in the French language.

BACKGROUND OF THE INVENTION

The present invention relates to an offshore production platform and methods of installing such a platform on a production site.

Jackup-type offshore production platforms, such as oil platforms for example, generally comprise legs, usually three in number, bearing on the seabed, and a deck mounted so as to be able to move with an adjustable height on the legs and carrying, in particular, production equipment and living premises.

The bottom end of each leg is fitted with a foot or stand designed to bear on the seabed when the platform is installed on a production site. This foot or stand of each leg provides a limited area of contact with the seabed, allowing the self-weight of the platform to be supported only under calm sea conditions and for a relatively short time.

For this reason, the legs of the platform have to be solidly anchored in the seabed for a long stay corresponding to a normal period of a production campaign.

A known method of achieving this is to fix each foot of the legs of the platform using piles driven deeply into the ground. But, given the size of such piles, this measure is a lengthy and costly operation because it requires intervention of heavy equipment whose operating cost is extremely high.

Another solution commonly adopted for anchoring the legs of the platform in the seabed involves combining a caisson, open at the bottom and fitted with a valve, with each leg. Each caisson is thrust into the seabed under the weight of the whole platform. In other cases, each caisson is combined with a pumping unit to reduce the caisson internal pressure and to cause this caisson to penetrate into the seabed to the required depth. These caissons combined with a pumping unit are referred to by specialists under the name of "suction pile".

Each caisson is generally stationary and extends below the foot or the stand of the corresponding leg; this has drawbacks.

During transportation of the preassembled platform from the erection site to the production site, either by floating the platform or by barge, these caissons, which are several meters high, are in the water and create high resistance to platform forward movement and thus additional energy expenditure.

Furthermore, this arrangement creates problems, when mounting the caissons onto the bottom end of the legs of the platform. The bottom end of each leg is submerged in most cases, so much so that handling these caissons requires heavy, complex infrastructure, due to the volumes to be controlled, because these caissons have a diameter of around 17 to 20 meters and a height that can attain several meters.

SUMMARY OF THE INVENTION

The invention is intended to overcome these drawbacks by proposing an offshore production platform whose cost of installation on an offshore site is reduced.

The subject of the invention is therefore an offshore production platform of a type comprising a deck moveably mounted on legs, each leg including, in its lower part, a stand for bearing on the seabed and a caisson open at its base and designed to penetrate into the seabed in order to anchor the platform, characterized in that each caisson is located inside a leg and can be moved along the axis of this leg between a retracted high position and a low position extended with respect to the stand of the leg and anchored in the seabed, and in that the caisson includes means of locking it onto the leg in the low position of said caisson.

According to particular embodiments:

- only the bottom end of this caisson extends below the stand of the leg in the retracted high position of the caisson and only the top end of said caisson is located inside the leg in the extended low position of the caisson;
- the leg includes at least one device bearing on the caisson in the retracted high position of this caisson;
- said device bearing on the caisson is formed by a bearing stop fixed to each member inside the corresponding leg;
- the distance separating the bearing stops and the stand of the leg is less than the height of the caisson of this leg;
- the means of locking each caisson include:
  - at least two opposing arms mounted on the bottom end of the caisson and extending above said caisson,
  - at least two opposing bottom stops located inside and at the bottom end of the leg and each designed to cooperate, in the low position of this caisson, with a stop located at the top end of the caisson, and
  - at least two opposing intermediate stops located inside the leg above the bottom stops and each designed to lock the free end of an arm in said low position of the caisson; and
- the arms are inclined toward the outside of the caisson and can be moved between this inclined position and an approximately vertical position during translation of the caisson.

The subject of the invention is also a method of installing a platform on an offshore production site, characterized in that it comprises the following steps:

- bringing the platform to the site by floating or by barge, the caisson of each leg being in a retracted high position;
- lowering the legs to apply the stand of each leg on the seabed;
- causing each caisson to penetrate into the seabed by pumping water into the caisson;
- locking each caisson, inside the corresponding leg, in an extended low position anchored in the seabed; and
- raising the deck of the platform to the required height.

The subject of the invention is also another method of installing an oil platform on an offshore production site, characterized in that it comprises the following steps:

- bringing the platform to the site by floating or by barge, the caisson of each leg being in a retracted high position;
- lowering the legs to apply the stand of each leg to the seabed;
- raising the deck of the platform to the required height;
- causing each caisson to penetrate into the seabed by pumping water inside the caisson; and
- locking each caisson, into the corresponding leg, in an extended low position anchored in the seabed.

The invention will be better understood on reading the following description given by way of example and with reference to the appended drawings, in which:

DESCRIPTION OF A PREFERRED EMBODIMENT

Figure 1:
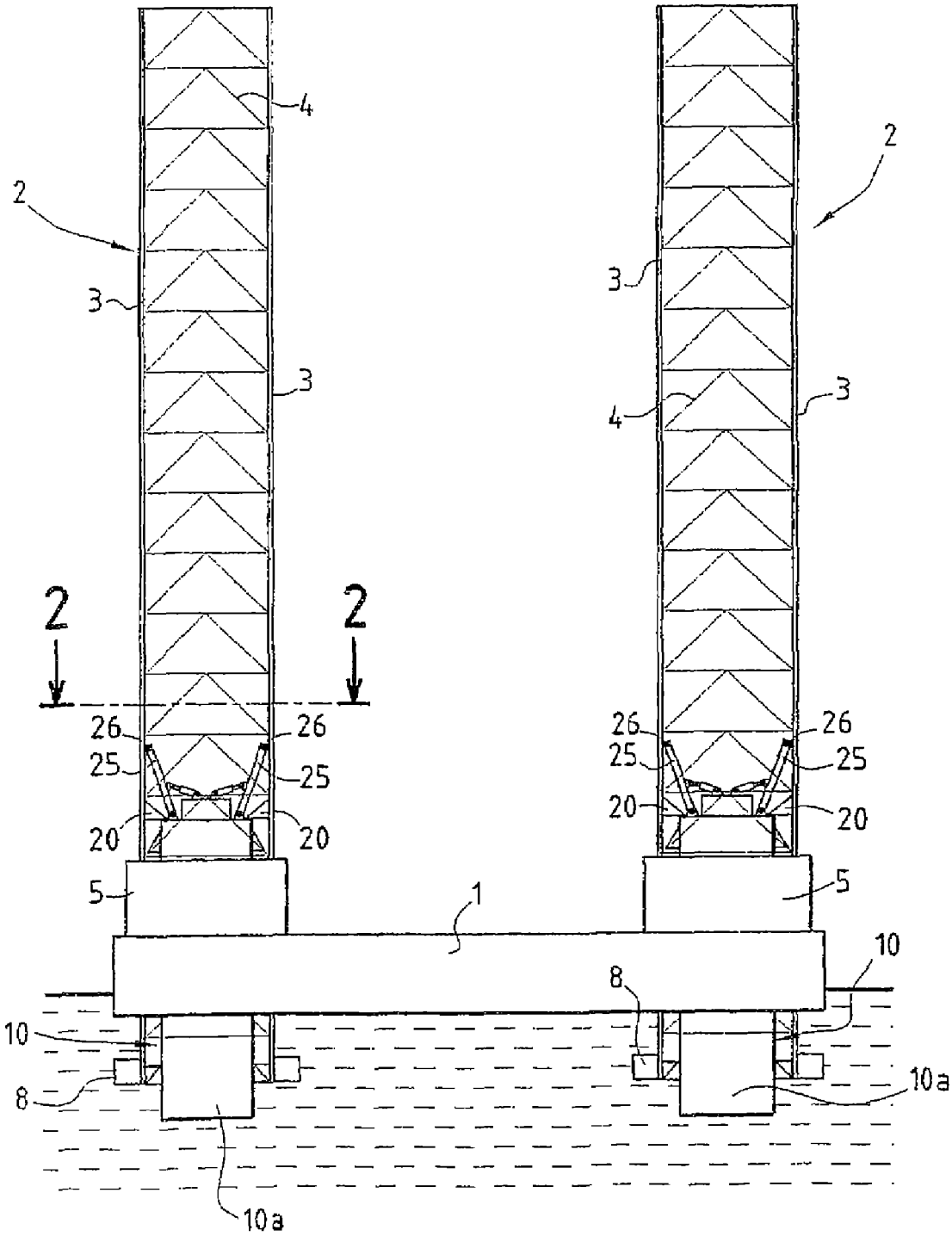
FIG. 1 is a schematic elevation view of an offshore production platform according to the invention and in a floating position.

FIG. 1 illustrates schematically an offshore production, in particular a jackup, platform comprising a deck 1 provided with the usual production equipment and living premises.

Figure 2:
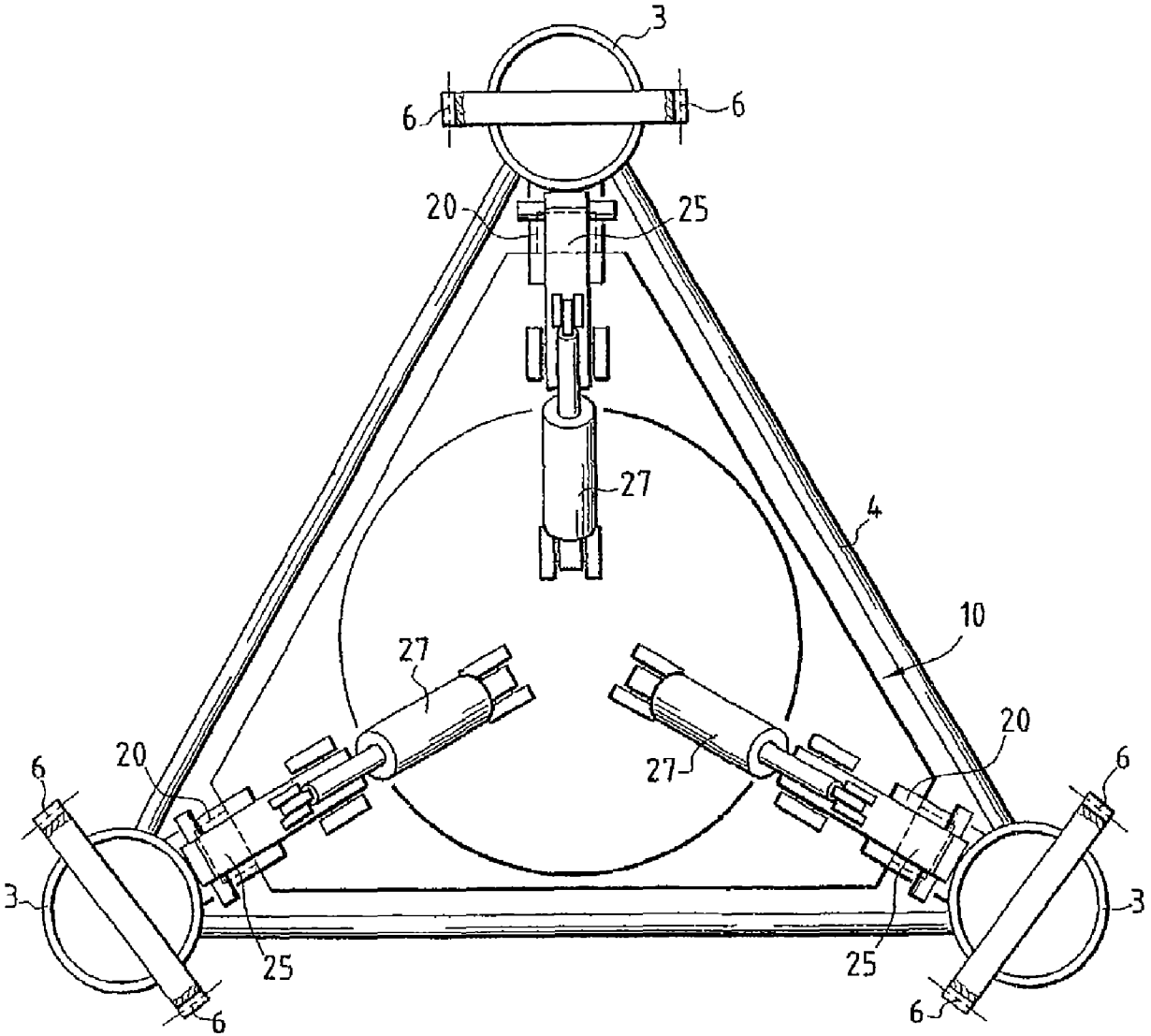
FIG. 2 is a schematic cross-sectional view of a leg of the platform and through line 2-2 of FIG. 1.

The deck 1 is moveably mounted on vertical legs 2, each of which is of triangular cross section, as shown in FIG. 2. These legs 2 can also be of square or circular cross section and they can number three or four, spaced uniformly on the deck 1.

Figure 6:
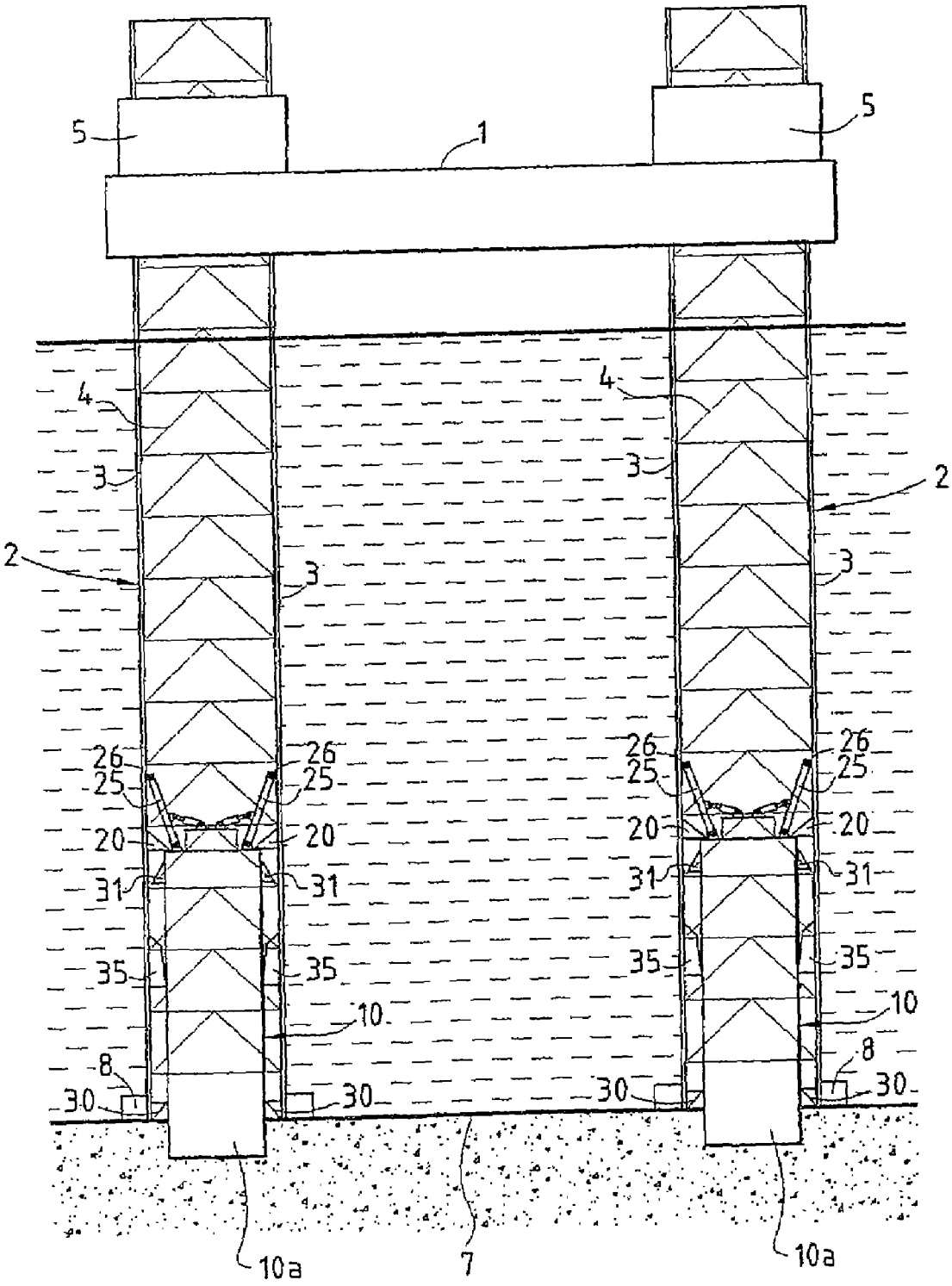
FIGS. 6 and 7 are schematic elevation views showing the steps of installing on the platform according to the invention a production site.
Figure 7:
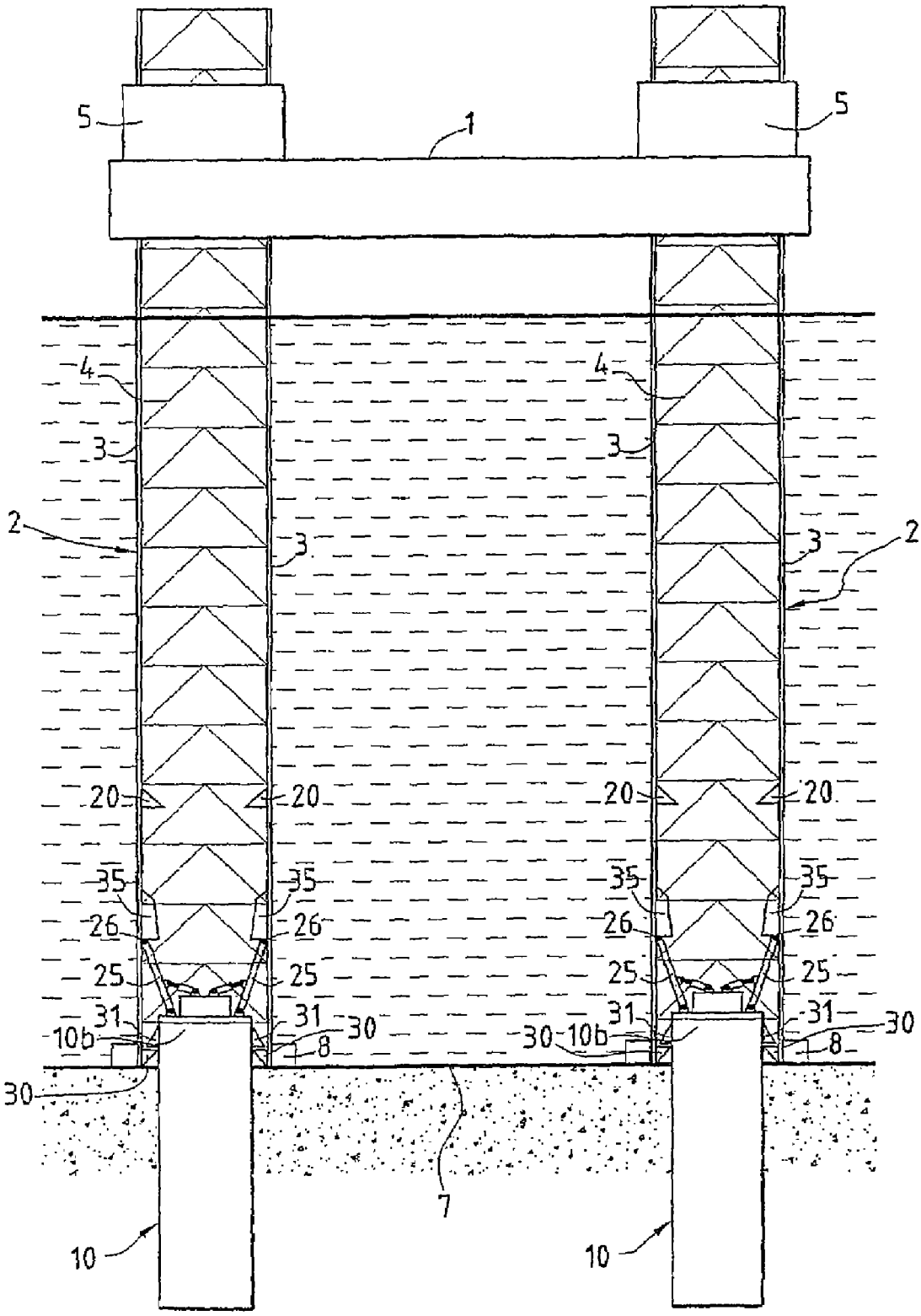

FIG. 2 shows that each leg 2 is made up of three members 3 interconnected by a lattice of steel struts 4. Only two members 3 are shown in FIGS. 1, 6 and 7 for simplicity.

Movement of the deck 1 along the legs 2 is performed using drive mechanisms, not represented, located for each leg in a supporting framework 5, also called a "jackhouse" by specialists. Each supporting framework 5 is carried by the deck 1 and the drive mechanisms are conventionally formed of reduction gear units each driving an output pinion cooperating with racks 6 located on the members 3 of each leg 2, as shown in FIG. 2. These legs 2 are designed to bear on the seabed 7 (FIGS. 6 and 7), when the platform is in a drilling or production position and the lower part of each leg 2 therefore ends with a stand 8.

Furthermore, the lower part of each leg 2 includes a caisson 10 open at its base and which is designed to penetrate into the seabed 7 down to a required depth so as to anchor the corresponding leg 2 in this seabed as will be later seen.

Each caisson 10 is conventionally connected to a pumping unit, not represented, in order to reduce the pressure inside the caisson 10 and to cause it to penetrate into the seabed 7 during installation of the platform on the production site.

These caissons are referred to by specialists under the name of "suction pile".

Figure 3:
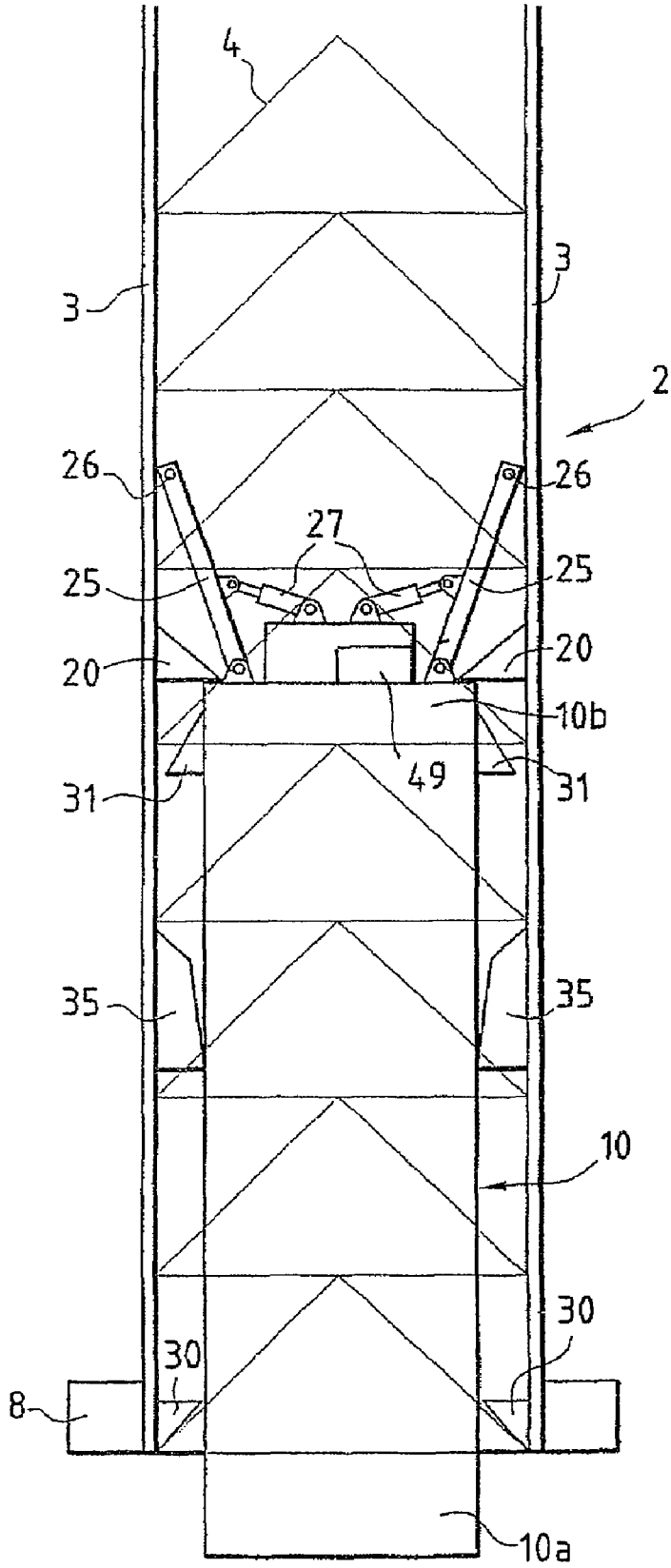
FIG. 3 is a schematic elevation view to a larger scale of the lower part of a leg of the platform according to the invention.

In the embodiment example represented in the figures and as FIG. 3 shows on a larger scale, the caisson 10 of each leg 2 is located inside the corresponding leg 2 and can be moved along the axis of this leg 2 between a retracted high position (FIGS. 1 and 3), in which only the bottom end 10*a* of this caisson 10 extends below the stand 8 of the leg 2, and a lower extended position (FIG. 7), in which only the top end 10*b* of this caisson 10 is located inside the leg 2.

Generally, the members 3 of each leg 2 include at least one device bearing on the corresponding caisson 10 in the high position of this caisson 10 to prevent said caisson from rising, when the lower end of this leg 2 is applied to the seabed 7 and each caisson 10 includes means of locking it onto the corresponding leg 2 in its low position to lock the caisson 10 in this low position which anchors the corresponding leg 2 to the seabed 7.

As displayed on FIGS. 2 and 3, each bearing device on the caisson 10 in each leg 2 is formed by a horizontal bearing stop 20 fixed to a member 3 inside the leg 2 above the top end 10*b* of the caisson 10 in its retracted high position (FIG. 3). The distance separating the bearing stops 20 and the stand 8 of the leg 2 is less than the height of the caisson 10 of this leg 2, thereby keeping the bottom part 10*a* of the caisson 10 below the stand 8 in the retracted high position of this caisson 10.

The means of locking a caisson 10 onto a leg 2 in the low position of this caisson 10 will now be described with particular reference now to FIGS. 3 to 5, the means of locking the other caissons 10 being identical.

The caisson 10 has a cross section corresponding to the cross section of the leg 2 and, in this case, a triangular cross section.

Figure 4:
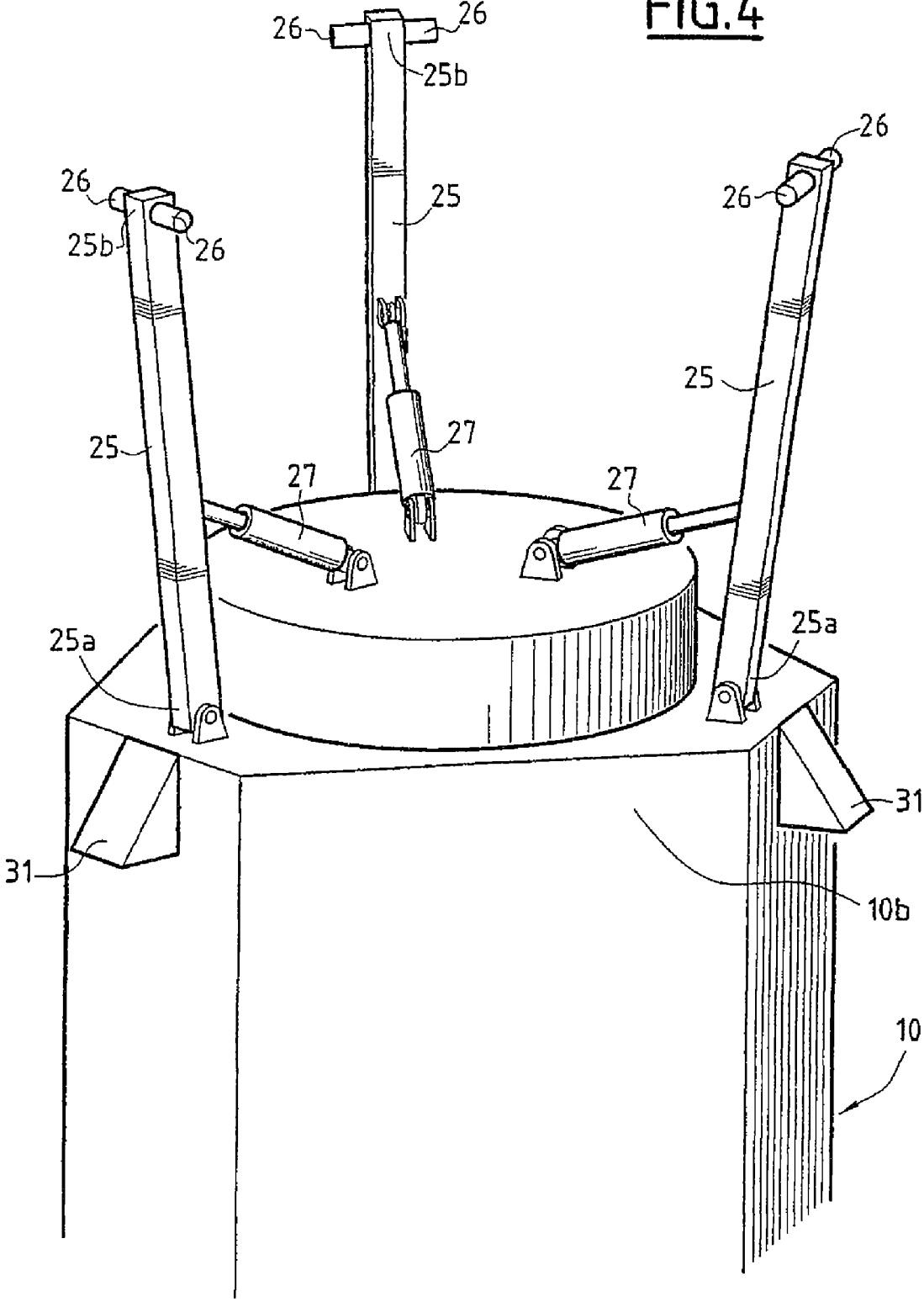
FIG. 4 is a schematic perspective view on a caisson for anchoring a leg of the platform according to the invention.
Figure 5:
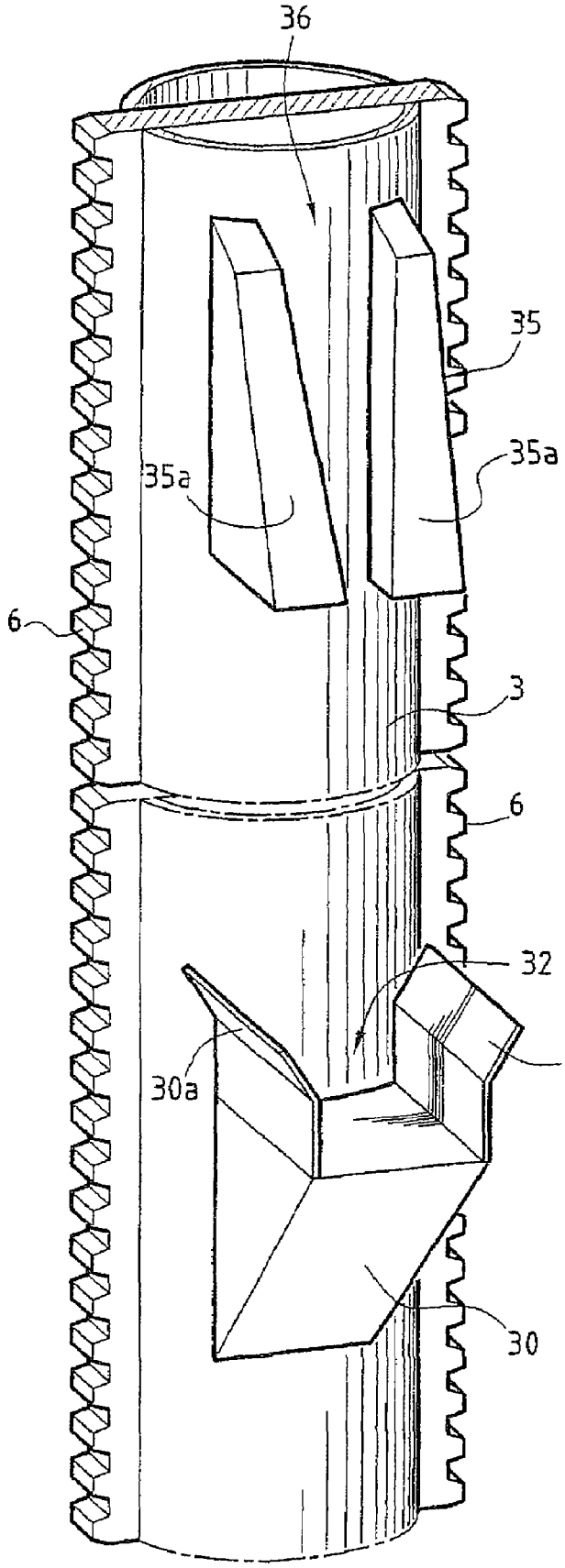
FIG. 5 is a schematic perspective view of the lower part of a member of a leg of the platform according to the invention.

The means of locking the caisson 10 comprise an arm 25 for each member 3 of the leg 2, mounted on the top end 10*b* of the caisson 10, as displayed in FIG. 4. The arms 25 extend above the caisson 10 and are inclined toward the outside of this caisson 10. In the embodiment example shown in FIG. 4, each arm 25 comprises a first end 25*a* mounted so as to articulate on the caisson 10 and a second end 25*b*, called the free end, which is fitted with two opposing pins 26 extending transversely with respect to the longitudinal axis of the arm 25. Each arm 25 can be moved between this inclined position, in which the end 25*b* is kept applied against a member 3 of the leg 2 and an approximately vertical position, when the caisson 10 is translated between the retracted high position and the extended low position, as will be described later.

According to an embodiment represented in FIG. 4, each arm 25 is moved, for example, by a cylinder 27, such as a hydraulic, air or electric cylinder located on the top face of the caisson 10, for example.

Each arm 25 can be moved by any other suitable device of known type, such as an elastic device keeping the corresponding arm 25 in its position inclined toward the outside of the caisson 10, for example. Moreover, each arm 25 can be of suitable shape for this arm to be inclined toward the outside of the caisson, in its normal position, and can have an elastic part keeping the arm in this position.

The means of locking the caisson 10 in the extended low position also include a bottom stop 30 (FIGS. 3 and 5) fixed to each member 3, located inside and at the bottom end of each member 3 of a leg 2.

Each stop 30 is designed to cooperate with a stop 31 located at the top end of the caisson 10 in the low position of this caisson 10. To position each stop 31 with respect to a bottom stop 30 during lowering of the caisson 10, each top lateral edge of the stops 30 is fitted with a flange 30*a* creating, with the opposing flange 30*a*, a space 32 extending upward in the shape of a V (FIG. 5) for guiding the corresponding stop 31.

Finally, the means of locking each caisson 10 include an intermediate stop 35 fixed to each member 3, located inside the leg 2 above the bottom stops 30. As shown in FIG. 5, each stop 35 is made up of two parallel components 35*a*, creating between them a V-shaped space 36 for guidance and passage of a stop 31 during lowering of the caisson 10.

In general, the means of locking each caisson 10 comprise at least two opposing arms 25, at least two opposing bottom stops 30 and at least two intermediate stops 35, also opposed. In the case of a leg 2 with a circular cross section, these components 25, 30 and 35 are preferably each three in number and in the case of a leg 2 with a square cross section, said components 25, 30 and 35 are preferably each four in number.

Installation of the platform on a production site is performed in the following way.

The platform is brought to site by floating or by barge. The legs 2 of the platform are in a raised position and the caisson 10 of each leg 2 is in a retracted high position inside the corresponding leg 2.

Each caisson 10 is kept in this position, for example by applying the ends 25*b* of the arms 25 to the members 3 of the legs 2 using the cylinders 27 or by any other suitable means, such as a chain linking the caisson 10 to the deck 1 of the platform, for example.

In this position, only the bottom part 10*a* of each caisson 10 extends below the stand 8 of each leg 2.

When the platform is at the production site, the legs 2 are gradually lowered using drive mechanisms carried by the deck 1, which act on the racks 6 of the members 3 of said legs 2. These legs 2 are gradually lowered until the stands 8 are applied on the seabed 7, as shown in FIG. 6. During lowering of each leg 2, the bearing stops 20 of the leg 2 are in contact with the caisson 10 such that the lower part 10*a* of the caisson 10 is caused to penetrate into the seabed 7.

After this first step, the next step involves anchoring the legs 2 into the seabed 7 using the caissons 10.

In the following description, the anchoring of a caisson 10 will be described, the anchoring of the other caissons 10 being identical.

To do this, the pressure inside the caisson 10 is reduced using the pumping unit associated with this caisson 10 in order to cause a gradual descent of this caisson 10, which penetrates into the seabed 7.

The pumping unit 49 is illustrated in FIG. 3 for pumping water from the caisson for controlling pressure inside the caisson 10.

During this descent, the cylinders 27 tilt the arms 25 approximately into a vertical position so as to allow these arms 25 to pass between the bearing stops 20 and between the intermediate stops 35. During this descent, again, the stops 31 of the caisson 10 pass into the space 36 between the components 35*a* of the intermediate stops 35 and these stops 31 come to bear on the bottom stops 30 of the members 3 of the legs 2, as shown in FIG. 7.

In this position, the caisson 10 is thrust into the seabed 7 to the required depth. The arms 25 are then tilted using the cylinders 27 toward the outside of the caisson 10 such that the pins 26 are applied against the intermediate stops 35, thereby locking the caisson 10 in its extended low position for anchoring the corresponding leg 2. The arms 25 thus prevent this caisson 10 from lifting and allow the vertical forces of each leg 2 to be transferred to the corresponding caisson 10. The deck 1 of the platform is then raised to the required height.

According to an alternative embodiment, the deck 1 of the platform can be raised before thrusting the caissons 10 into the seabed 7.

The stops 30 and 31, which are in contact in the position for anchoring the legs 2 by the caissons 10, allow these caissons 10, should the legs 2 lift, to follow this movement.

According to another embodiment, each caisson 10 can be fully retracted into the corresponding leg 2. In this case, the members 3 are not fitted with the bearing stops 20 and the bottom end 10*a* of each caisson 10 does not extend below the stand 8 in the retracted high position of the caisson 10.

The retractable anchoring caissons inside the legs offer the platform according to the invention the advantage of a reduced draught during its transportation to the production site compared with the platforms of this type used until now.

The invention claimed is:

1. An offshore production platform based on a seabed, the platform comprising:

a deck including legs, the deck being moveably mounted on the legs, each leg including a lower part and a stand at the lower part of the leg operable for bearing on the seabed;

a caisson inside each leg, the caisson including a base with a bottom side open and being operable to penetrate with the base first into the seabed to anchor the platform;

the caisson being movable along an axis of the leg between a caisson retracted high position and a caisson low position at which the caisson is extended with respect to the stand of the leg and at which the caisson is anchored in the seabed; and a locking device operable for locking the caisson onto the leg in the caisson low position, wherein the locking device at each caisson comprises:

a top end, and a plurality of top stops positioned at the top end of the caisson;

at least two arms mounted on the top end of the caisson and extending above the caisson;

at least two bottom stops located inside of and at the lower part of the leg, each bottom stop being positioned, shaped and operable to cooperate in the caisson low position with a respective top stop of the plurality of top stops; and at least two intermediate stops located inside the leg above the at least two bottom stops and each intermediate stop operable to lock a free end of a respective arm of the at least two arms in the caisson low position.

2. The platform as claimed in claim 1, wherein the caisson includes a bottom end region of the caisson, and the bottom end region extends below the stand of the leg in the caisson retracted high position, a top end region of the caisson located inside the leg so that at the caisson low position only the top end region is located inside the leg.

3. The platform as claimed in claim 2, further comprising at least one bearing device positioned in the leg, the at least one bearing device being positioned and configured to bear on the caisson in the caisson retracted high position.

4. The platform as claimed in claim 3, wherein the leg includes upstanding members along a height thereof, and the at least one bearing device comprises a plurality of bearing stops, each bearing stop fixed to a respective one of the upstanding members inside the leg.

5. The platform as claimed in claim 4, wherein each of the plurality of bearing stops and the stand of the leg are separated by a distance less than a height of the caisson at the leg.

6. The platform as claimed in claim 1, wherein each arm of the at least two arms has an inclined position toward an outside periphery of the caisson, each arm being movable between the inclined position and a vertical position during translation of the caisson along the leg.

7. The platform as claimed in claim 1, wherein the caisson includes a pumping unit operable to vary a pressure inside the caisson.

8. An offshore production platform based on a seabed, the platform comprising:

a deck including legs, the deck being moveably mounted on the legs, each leg including a lower part and a stand at the lower part of the leg operable for bearing on the seabed;

a caisson positioned inside each leg, the caisson configured to penetrate into the seabed to anchor the platform;

the caisson being movable along a longitudinal axis of the leg between a caisson retracted high position and a caisson low position, the caisson being extended with respect to the stand of the leg and anchored in the seabed in the caisson low position; and each leg comprising a locking device comprising a structure of the leg fixed with respect to the longitudinal axis of the leg and configured to contact the caisson for locking the caisson onto the leg in the caisson low position so as to anchor the leg, the caisson comprising:

a top end, and a top stop located at the top end of the caisson;

an arm mounted on the top end of the caisson and extending above the caisson;

a bottom stop located inside of and at the lower part of the leg, the bottom stop being positioned, shaped and operable to cooperate in the caisson low position with the top stop located at the top end of the caisson; and an intermediate stop located inside the leg above the bottom stop and operable to lock a free end of the arm in the caisson low position.

* * * * *